US006829832B2

(12) United States Patent
Chang

(10) Patent No.: US 6,829,832 B2
(45) Date of Patent: Dec. 14, 2004

(54) SINGLE-HANDLE CAN OPENER

(75) Inventor: Kun-Jen Chang, Yung Kang (TW)

(73) Assignee: Alston Technologies Development Co., Ltd., Tainan Hsien (TW)

( * ) Notice: Subject to any disclaimer, the term of this patent is extended or adjusted under 35 U.S.C. 154(b) by 2 days.

(21) Appl. No.: 10/327,136

(22) Filed: Dec. 24, 2002

(65) Prior Publication Data

US 2004/0117994 A1 Jun. 24, 2004

(51) Int. Cl.[7] ..... B67B 7/72

(52) U.S. Cl. ..... 30/417; 30/418; 30/422; 30/424

(58) Field of Search ..... 30/416, 417, 418, 30/420, 421, 422, 426, 434, 400

(56) References Cited

U.S. PATENT DOCUMENTS 3,277,570 A * 10/1966 McLean ..... 30/404
3,345,742 A * 10/1967 McLean ..... 451/461
3,781,989 A * 1/1974 Swetlitz et al. ..... 30/417
3,983,625 A * 10/1976 McLean ..... 30/401
4,050,155 A * 9/1977 Pitocchi ..... 30/400
4,236,428 A * 12/1980 Feamster, III ..... 82/128
4,782,594 A * 11/1988 Porucznik et al. ..... 30/417
5,367,776 A * 11/1994 Chong ..... 30/417
5,946,811 A * 9/1999 Chang ..... 30/417
6,101,727 A * 8/2000 Chong ..... 30/418
6,691,419 B2 * 2/2004 Chang ..... 30/417

FOREIGN PATENT DOCUMENTS

GB 2161449 A * 1/1986 ..... B67B/7/60

* cited by examiner

*Primary Examiner*—Stephen Choi
(74) *Attorney, Agent, or Firm*—Rosenberg, Klein & Lee

(57) ABSTRACT

A can opener has a shaft for effecting rotation of a traction wheel for moving a can relative to a cutting wheel to sever an upper annular lateral side of the can, and is equipped with an adjustment element, which is screwed onto a threaded outward end portion of the shaft, and which has two wing portions in contact with corresponding sloping portions of a hexagonal member so that when the shaft is turned together with a rotary lever in the cutting direction, the hexagonal member is first turned relative to the adjustment element for a small angle for the higher portions of the sloping portions to be pressed against the wing portions to cause reduction to the space between the traction wheel and the cutting wheel; thus, the wheels can clip an annular wall of a end cover of a can in between.

2 Claims, 6 Drawing Sheets

SINGLE-HANDLE CAN OPENER

BACKGROUND OF THE INVENTION

1. Field of the Invention

The present invention relates to a can opener, more particularly a can opener, which has a single handle, and which is relatively easy to assemble, and can be manufactured with necessary precision relatively easily.

2. Brief Description of the Prior Art

Can openers that have handles operable in laid-down position and are used for cutting the annular sides of cans are among various can openers commercially available. Can openers that have handles operable in laid-down position and are used for cutting the annular sides of cans can be made to consist of a single handle.

Referring to FIG. 6, a popular conventional can opener 2 with a single handle includes a handle 21, a cutting wheel 22, a transmission shaft 23, and a rotary lever 26. There are U-shaped rod 24, and a curved projection 25 provided on an inner side of a front end of the handle 21, which are to be pressed against corresponding parts of a can to locate the handle 21. The cutting wheel 22 extends out between the U-shaped rod 24 and the curved projection 25 from the inner side of the handle 21. The transmission shaft 23 is passed through the front end of the handle 21. Connected to the inner end of the transmission shaft 23 is the traction wheel 231, which is to be pressed against an inner side of an end cover of a can for making the can to move relative to the cutting wheel 22 when the rotary lever 26 is operated; the rotary lever 26 is connected to the other end of the transmission shaft 23 so that the user can turn the rotary lever 26 to effect rotation of the shaft 23 and the traction wheel 231. Thus, when the rotary lever 26 is turned, a can engaged with the can opener is forced to move relative to the cutting wheel 22, and an upper annular side of the can is severed by means of the cutting wheel 22.

Referring to FIG. 7, an exploded perspective view of the above can opener, formed on the front end of the handle 21 is a stepped hole 211 for the shaft 23 to pass through; the stepped hole 211 has a bigger inner end for holding a sleeve 232 and a spring 233. The transmission shaft 23 has a locating hole 234 formed across the outward end thereof; the locating hole 234 is formed by means of drills. Fitted around the outward end of the shaft 23 is a hexagonal member 27, which has opposite gaps 271 at an outward end, and slopes 272 facing the gaps 271. The rotary lever 26 has a hexagonal hole 261 in the middle. There are adjustment pads 236 fitted around the shaft 23 and disposed between the outward side of the handle 21 and the hexagonal member 27 for adjusting the distance between the traction wheel 231 and the blade of the cutting wheel 22 with. After the shaft 23 is passed through the spring 233, the sleeve 232, the stepped hole 211, the adjustment pads 236, and the hexagonal member 27, an adjustment pin 235 is passed through the locating hole 234 of the shaft 23 with two ends thereof being held in the opposite gaps 271 of the hexagonal member 27; referring to FIGS. 8, and 9, if the lever 26 is not turned in the cutting direction, the ends of the adjustment pin 235 will be pressed against lower ends of the slopes 272 of the hexagonal member 27 owing to the spring 233. The rotary lever 26 is joined to the hexagonal member 27 at the hexagonal hole 261. Thus, the traction wheel 231 can be made to stay in a not-action position farther away from the cutting wheel 22 when the ends of the adjustment pin 235 are pressed against the lower ends of the slopes 272.

When the U shaped rod 24 and the cutting wheel 22 are pressed against corresponding portions of a can and when the lever 26 is turned in the cutting direction, i.e. counter-clockwise in the FIGS., the hexagonal member 27 will first be turned relative to the adjustment pin 235 so that the ends of the adjustment pin 235 are pressed against the higher ends of the slopes 272 instead, and in turn, the shaft 23 is made to slide outwards and the traction wheel 231 is pressed against the inner side of the annular portion of the can cover. Thus, the upper annular lateral side of the can can be severed by means of the cutting wheels 22 when the user continues to turn the lever 26 in the cutting direction to move the can relative to the cutting wheel 22.

This can opener is convenient to use, however, it is found to have disadvantages as follows:

1. It is relatively difficult to drill across the shaft 23 to make the locating hole 234 because the shaft 23 is cylindrical, and drills used in the drilling process are prone to be diverted or to break, causing defect rate to increase and endangering the workers. Consequently, the manufacturing cost is relatively high.
2. The shaft 23 is usually made of relatively hard steel that has large proportion of carbon; therefore, it is difficult to make the locating hole 23 in predetermined position with precision.
3. Should the locating hole 234 be not formed in such a manner that an axis thereof and that of the shaft 23 intersect and perpendicular to each other, those portions of the shaft 23 that are beside the locating hole 234 will not be the same, and strength of the shaft 23 is reduced. And, the locating hole 234 is prone to be formed off the predetermined position. Consequently, workers have to spend time in finding adjustment pads with suitable thickness for offsetting the errors, otherwise the traction wheel 23 can't be engaged with the inner side of the annular portion of the can cover with proper pressure, and the smoothness of the cutting operation can be reduced.
4. It is necessary to round off two ends of the locating hole 234 for allowing the adjustment pin 235 to be inserted through the locating hole 234 easily. However, a drill used for the rounding-off process is prone to be diverted because the ends of the locating hole 234 curve together with the lateral side of the shaft 23; when the drill comes into contact with the convexly curved portions of the ends of the hole 234, it can't move smoothly. In addition, the ends of the locating hole 234 have to be polished manually after the rounding-off process, causing increase of manufacturing cost. The adjustment pin 235 is very smooth on the surface therefore it is likely to fall off the locating hole 234 in assembly causing trouble to the laborers.

SUMMARY OF THE INVENTION

It is a main object of the present invention to provide a single-handle can opener, which is equipped with an adjusting mechanism capable of being easily manufactured and assembled.

It is another object of the present invention to provide a single-handle can opener, which can be provided with precision in respect of the space between the cutting wheel and the traction wheel, either in the action position or in the not-action position.

It is yet another object of the present invention to provide a single-handle can opener, of which the adjusting mechanism can't become loose during the course of the rotary lever is turned in the cutting direction to open a can.

The present can opener is equipped with an adjustment element instead of the pin of the prior art, and the shaft is formed with threads on the outward end portion instead of the locating hole of the prior art. The adjustment element is screwed onto the outward end of the transmission shaft, and has two wing portions in contact with the sloping portions of the hexagonal member so that the sloping portions can effect reduction of the space between the traction wheel and the cutting wheel upon rotational operation of the lever in the cutting direction.

BRIEF DESCRIPTION OF THE DRAWINGS

The present invention will be better understood by reference to the accompanying drawings, wherein.

DETAILED DESCRIPTION OF THE PREFERRED EMBODIMENTS

Figure 1:
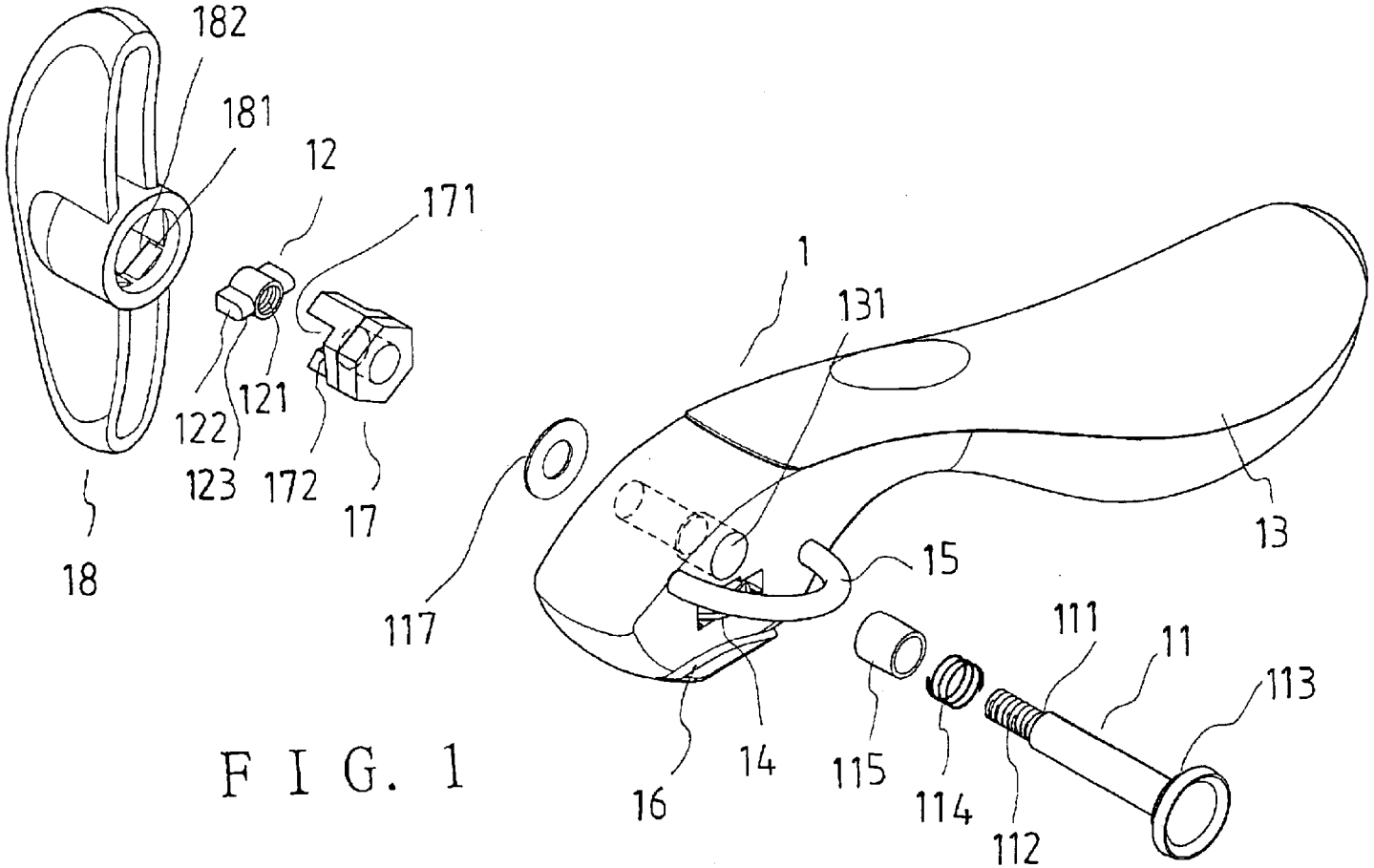
FIG. 1 is an exploded perspective view of the can opener according to the present invention.

Referring to FIG. 1, the can opener 1 with a single handle according to the present invention includes a handle 13, a hexagonal member 17, a rotary lever 18, a spring 114, a sleeve 115, adjustment pads 117, a traction wheel 113, and a cutting wheel 14, which are all the same as those corresponding parts of the conventional can opener as described in the Background, and has a transmission shaft 11, and an adjustment element 12.

Like the handle 21 of the conventional can opener, the handle 13 has an U-shape rod 15 and a curved projection 16 provided on an inward side of a front end thereof, and the cutting wheel 14 sticks out from the inward side of the handle 13 between the U-shape rod 15 and the curved projection 16. And, the handle 13 has a stepped hole 131.

Like the hexagonal member 27 of the conventional can opener, the hexagonal member 17 has two opposite gaps 171 and two sloping portions 172 facing corresponding gaps 171.

Like the rotary lever 26 of the conventional can opener, the rotary lever 18 has a hexagonal hole 181 in the middle thereof.

The traction wheel 113 is connected to the inward end of the transmission shaft 11, like that of the conventional can opener.

There is a threaded hole 121 formed on a middle of the adjustment element 12, and there are wing portions 122 extending from two sides of the threaded hole 121 of the adjustment element 12. Each of the wing portions 122 has a convexly curved edge, which is to be in contact with the sloping portions 172 of the hexagonal member 17 for helping increase smoothness when the adjustment element 12 is moving relative to the sloping portions 172.

The shaft 11 has an outward end portion thinner than a stopping portion 111 of the shaft 11 that is adjacent to the outward end portion. There are threads 112 formed on the thinner outward end portion of the shaft 11.

The way of joining the handle 13, the hexagonal member 17, the rotary lever 18, the spring 114, the sleeve 115, the adjustment pads 117, the traction wheel 113, and the cutting wheel 14 of the present can opener is the same as that of joining the corresponding parts of the conventional can opener therefore it is not detailed here again.

Figure 5:
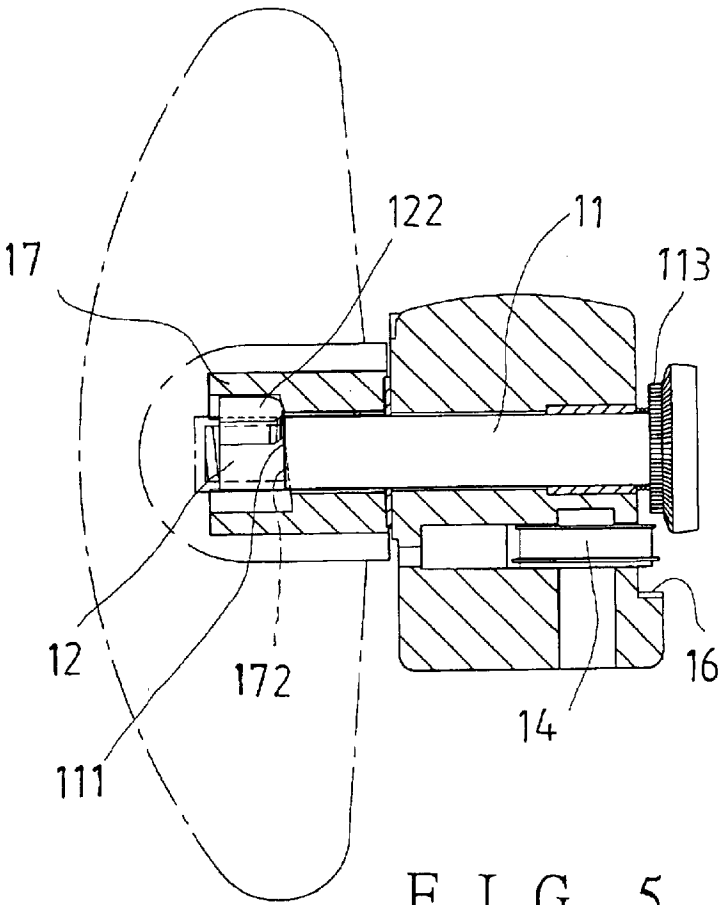
FIG. 5 is a cross-sectional view of the can opener, in the second position, according to the present invention.
Figure 4:
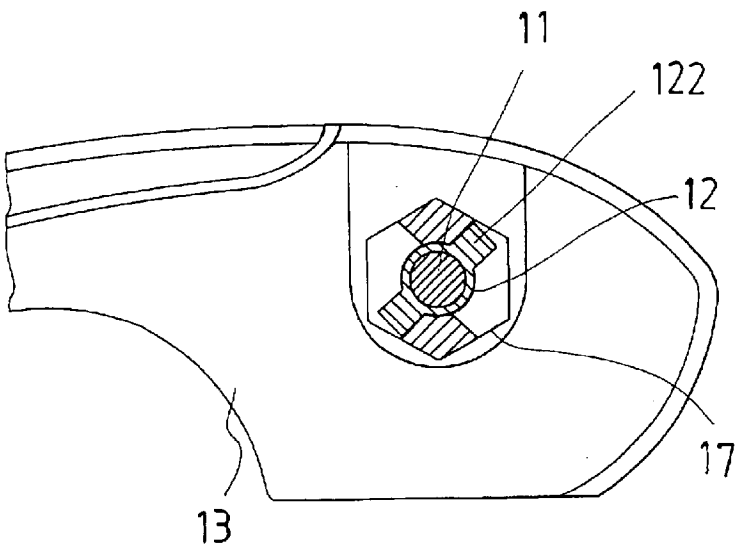
FIG. 4 is a partial cross-sectional view of the can opener, in the second position, according to the present invention.
Figure 6:
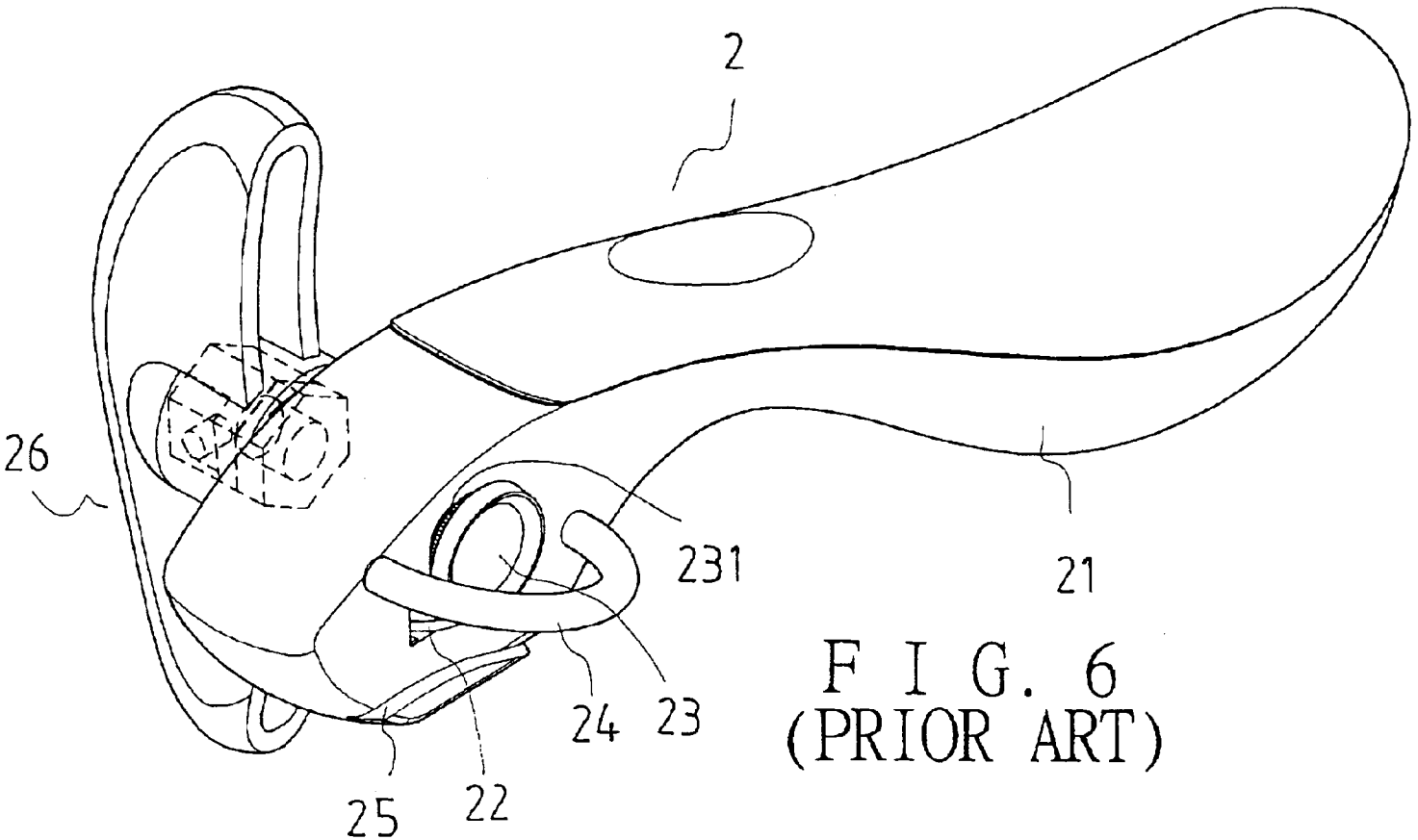
FIG. 6 (PRIOR ART)
FIG. 6 is a perspective view of the conventional can opener with a single handle as described in the Background.
Figure 7:
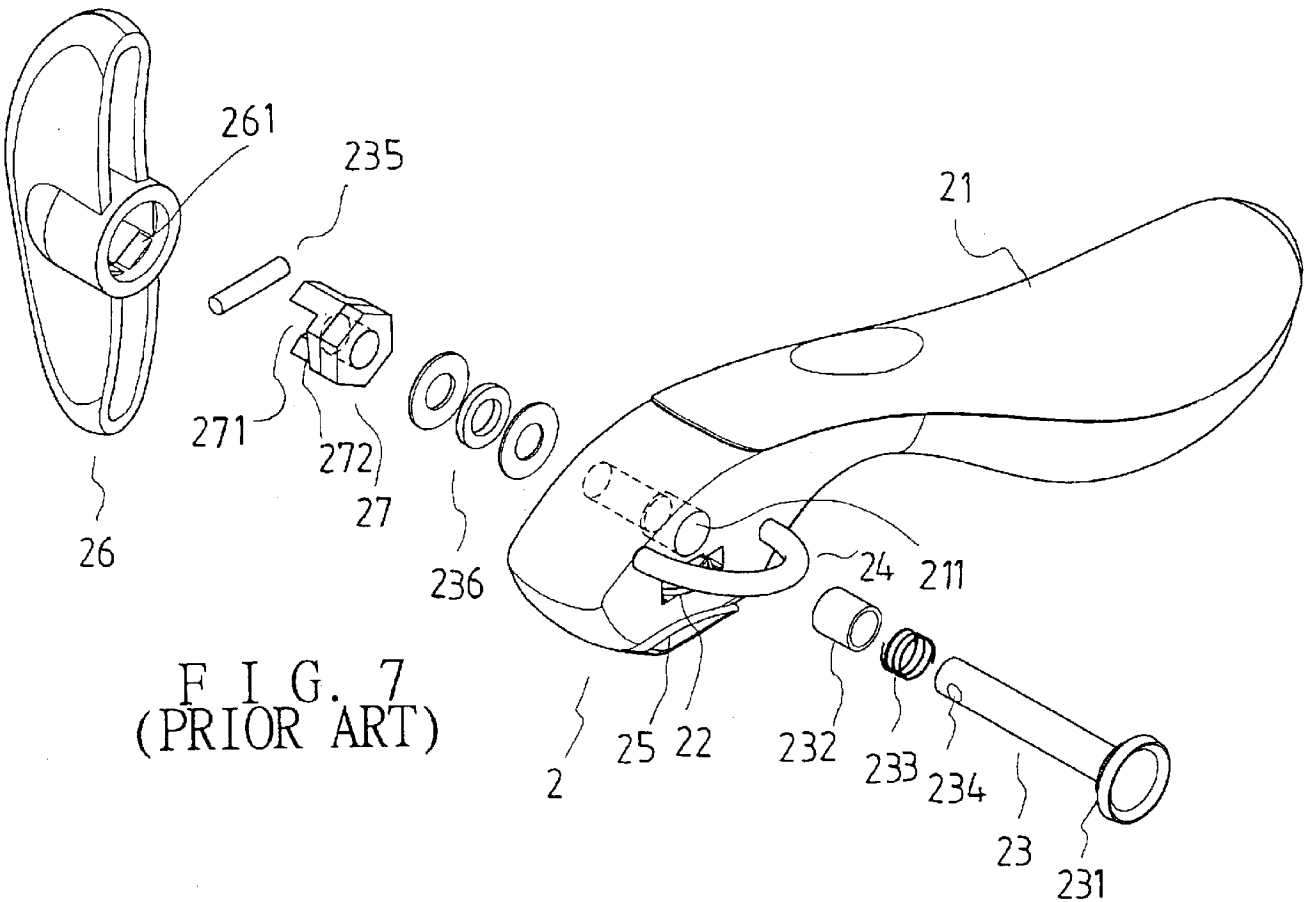
FIG. 7 (PRIOR ART)
FIG. 7 is an exploded perspective view of the conventional can opener with a single handle.
Figure 9:
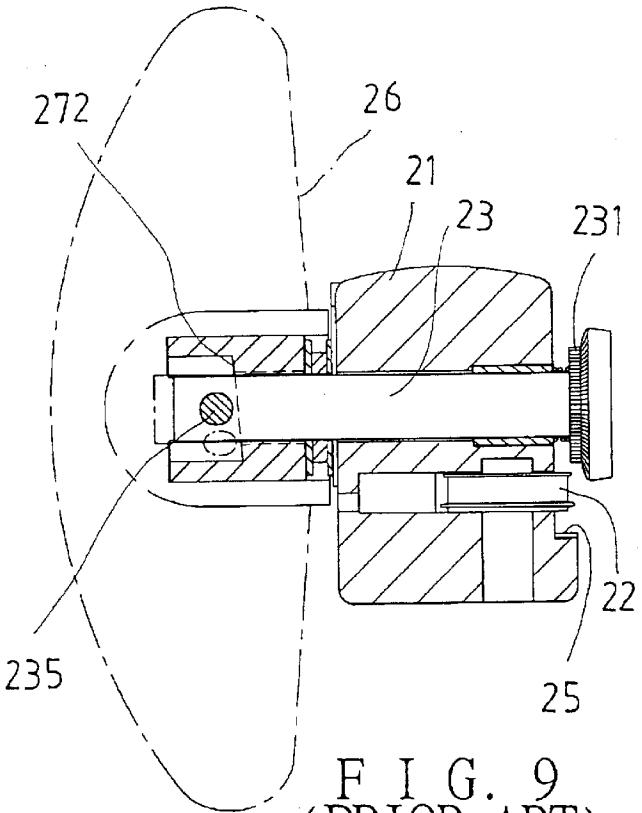
FIG. 9 (PRIOR ART)
Figure 8:
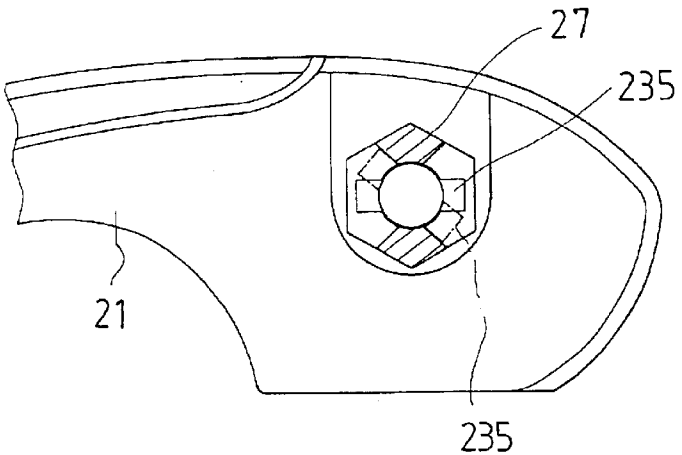
FIG. 8 (PRIOR ART)
FIG. 8 is a partial cross-sectional view of the conventional can opener with a single handle; and, FIG. 9 is a cross-sectional view of the conventional can opener.

The adjustment element 12 is fitted into the gaps 171 of the hexagonal member 17, and is screwed onto the threads 112 of the transmission shaft 11 at the threaded hole 121 thereof, and is stopped from turning further until it comes into contact with the stopping portion 111 of the shaft 11; thus, the wing portions 122 contact the sloping portions 172 of the hexagonal member 17. Furthermore, there is a stopping edge 182 formed at the end of the hexagonal hole 181; the ends of the wing portions 122 will be stopped from moving further into the hexagonal hole 181 of the lever 18 by the stopping edge 182 after the lever 18 is joined to the hexagonal member 17. Referring to FIGS. 4, and 5, if the lever 18 is not turned in a cutting direction, i.e. counterclockwise in FIG. 1, the wing portions 122 of the adjustment element 12 will be pressed against lower ends of the sloping portions 172 of the hexagonal member 17 owing to the spring 114. Thus, the traction wheel 113 can be made to stay in a not-action position farther away from the cutting wheel 14.

Figure 3:
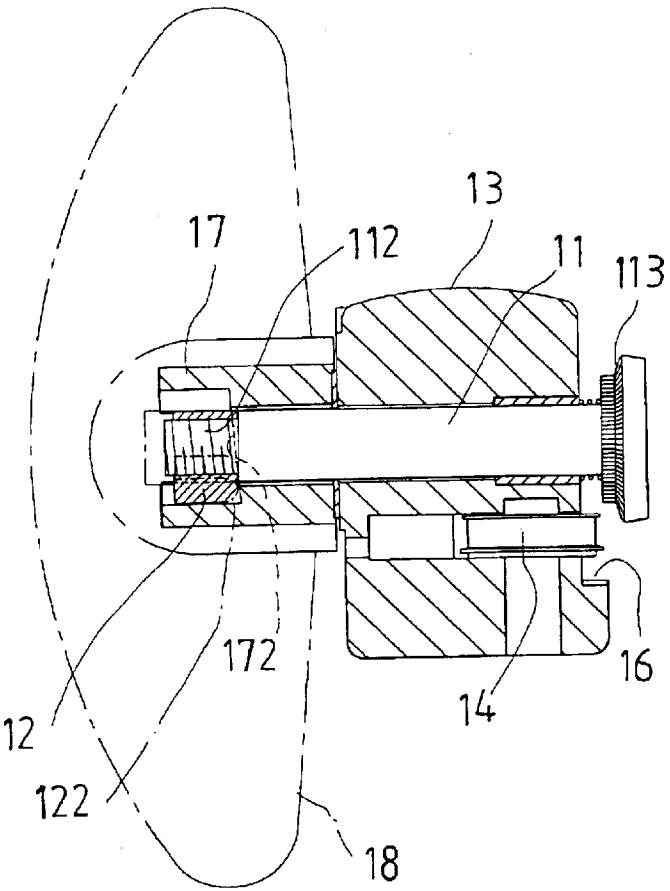
FIG. 3 is a cross-sectional view of the can opener, in the first position, according to the present invention.
Figure 2:
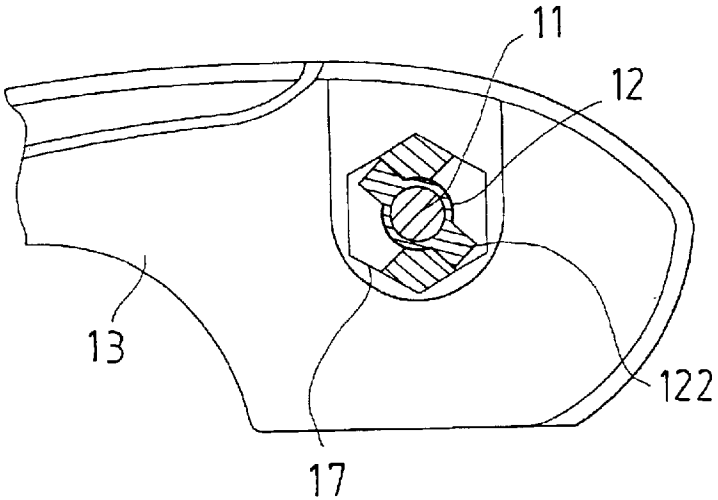
FIG. 2 is a partial cross-sectional view of the can opener, in the first position, according to the present invention.

Referring to FIGS. 2, and 3, when the U-shaped rod 15 and the cutting wheel 14 are pressed against corresponding portions of a can and when the lever 18 is turned in the cutting direction, the hexagonal member 17 will first be turned relative to the adjustment element 12 so that the wing portions 122 of the element 12 are pressed against the higher ends of the slopes 172 instead, and in turn, the shaft 11 is made to slide outwardly of the can, and the traction wheel 113 is moved to the action position where it is pressed against the inner side of the annular portion of the upper end cover of the can. In other words, the space between the traction wheel 113 and the cutting wheel 14 is reduced. Thus, the upper annular lateral side of the can can be severed by means of the cutting wheels 14 when the user continues to turn the lever 18 in the cutting direction to move the can relative to the cutting wheel 14.

When the wing portions 122 are pressed against the higher ends of the slopes 172, they will become coplanar with the outward end of the hexagonal member 17 to be stopped from moving further into the rotary lever 18 by the stopping edge 182. Therefore, the adjustment element 12 can't possibly become loose during the course of rotational operation of the lever 18 in the cutting direction for opening a can. The adjustment element 12 can be separated from the shaft 11 only after the lever 18 has been removed.

From the above description, it can be easily understood that the can opener of the present invention has advantages as followings:

1. The transmission shaft 11 is cylindrical, and threads can be easily formed on it by means of the very lathe that is used to make the transmission shaft 11. And, the transmission shaft 11 can be easily made with precision in respect of the length of the threaded outward end portion thereof by means of using precision control, e.g. CNC, on the lathe. In other words, the space between the traction wheel, either in the action position or in the not-action position, and the cutting wheel can be set with precision and easily Consequently, the can opener product can be operated relatively smoothly.

2. Because threads can be formed on the shaft with precision more easily than a transverse hole of the prior art, the manufacturing cost and the defective rate of the present invention are lower.

3. The wing portions of the adjustment element 12 are relatively thick and strong as compared with the pin of the prior art, and the adjustment element can't fall off the hexagonal member in assembly, saving the labors a lot of trouble. And, the adjustment element will only become tighter around the shaft during the course of the lever 18 is turned in the cutting direction.

What is claimed is:

1. An adjustment mechanism of a can opener with a single handle, comprising:

a transmission shaft having a traction wheel connected to an inward end thereof; the transmission shaft being passed through a handle of a can opener with the traction wheel being faced with both an inward side of the handle and a cutting wheel fitted on the handle, the transmission shaft terminating at a solid outward end;

a spring joined to the shaft to bias the traction wheel away from the cuffing wheel towards the disengaging position;

a hexagonal member arranged beside an outward side of the handle and fitted around the shaft; the hexagonal member having two opposite gaps and two sloping portions facing corresponding gaps;

an adjustment element joined to the outward end of the shaft and in contact with the sloping portions of the hexagonal member; and a rotary lever fitted onto the hexagonal member at a middle hexagonal hole thereof, the transmission shaft being axially displaceable responsive to actuation of the rotary lever between engaging and disengaging positions relative to the handle;

a threaded hole being formed on a middle portion of the adjustment element and threads on the outward end of the shaft, the adjustment element to be screwed onto the outward end of the transmission shaft for releasably tightened coupling thereto, and two wing portions being extended from two sides of the middle portion of the adjustment element to come into contact with the sloping portions of the hexagonal member so that the sloping portions can effect reduction of space between the traction wheel and the cutting wheel upon rotational operation of the lever in a cutting direction forcing the adjustment element to cause the traction wheel to turn together with it.

2. The adjustment mechanism of a can opener with a single handle as claimed in claim 1, wherein the handle is provided with both a locating U-shaped rod and a curved projection on the inward side thereof, which are to be pressed against corresponding portions of a can when the can opener is used, and the cutting wheel is pressed against an upper annular lateral side of a can, and the traction wheel against an inner side of an annular portion of an upper end cover of the can when the can opener is used.

* * * * *